US007552830B2

(12) United States Patent
Radewagen

(10) Patent No.: US 7,552,830 B2
(45) Date of Patent: Jun. 30, 2009

(54) CENTRAL BUFFER COUPLING FOR RAIL-MOUNTED VEHICLES

(75) Inventor: Christian Radewagen, Salzgitter (DE)

(73) Assignee: Voith Turbo Scharfenberg GmbH & Co. KG, Salzgitter-Watenstedt (DE)

( * ) Notice: Subject to any disclaimer, the term of this patent is extended or adjusted under 35 U.S.C. 154(b) by 239 days.

(21) Appl. No.: 11/593,793

(22) Filed: Nov. 7, 2006

(65) Prior Publication Data

US 2007/0107623 A1 May 17, 2007

(51) Int. Cl.

| | |
|---|---|
| ***B61G 9/02*** | (2006.01) |
| ***B61G 9/00*** | (2006.01) |
| ***B61G 5/00*** | (2006.01) |
| ***B61G 11/00*** | (2006.01) |

(52) U.S. Cl. ..... 213/9; 213/20; 213/75 R; 213/220

(58) Field of Classification Search ..... 213/220, 213/221, 222, 10; 267/138
See application file for complete search history.

(56) References Cited

U.S. PATENT DOCUMENTS

| | | | | |
|---|---|---|---|---|
| 910,163 | A * | 1/1909 | Benninghoff | 137/625.68 |
| 2,959,251 | A * | 11/1960 | Landman et al. | 180/276 |
| 3,084,809 | A * | 4/1963 | Lucchese | 213/220 |
| 3,159,284 | A * | 12/1964 | Holm | 213/22 |
| 4,576,294 | A * | 3/1986 | Forster | 213/9 |
| 6,047,839 | A * | 4/2000 | Huggins | 213/220 |
| 6,315,139 | B1 * | 11/2001 | Kreher | 213/9 |
| 6,685,040 | B2 * | 2/2004 | Heinisch et al. | 213/221 |
| 2003/0116519 | A1 * | 6/2003 | Radewagen et al. | 213/20 |
| 2005/0145591 | A1 * | 7/2005 | Mattschull et al. | 213/75 R |
| 2007/0107623 | A1 * | 5/2007 | Radewagen | 105/50 |

FOREIGN PATENT DOCUMENTS

| | | | |
|---|---|---|---|
| DE | 35 13 294 | A1 | 10/1986 |
| DE | 3513294 | A1 | 10/1986 |
| EP | 0947410 | A1 | 3/1999 |
| EP | 0 947 410 | A1 | 10/1999 |
| GB | 910 163 | A1 | 11/1962 |
| GB | 910163 | | 11/1962 |

OTHER PUBLICATIONS

PCT Notification of the International Preliminary Report and Written Opinion, Int'l Appl. No. PCT/EP2006/002903, Int'l Filing Date Mar. 30, 2006, mailed Dec. 13, 2007, 6 pages.

* cited by examiner

*Primary Examiner*—S. Joseph Morano
*Assistant Examiner*—Jason C Smith
(74) *Attorney, Agent, or Firm*—Cesari and McKenna, LLP

(57) ABSTRACT

A central buffer coupling for rail-mounted vehicles has a coupling shaft (1) and a drawgear (2) comprising a bearing bracket (4), whereby the rear end (3) of the coupling shaft (1) is connected to the drawgear (2) and coupled to the car body of the rail vehicle via the bearing bracket (4) of the drawgear (2) so as to be horizontally pivotable. The drawgear (2) includes a shock absorber (5, 8), wherein the shock absorber (5, 8) is configured such that upon the exceeding of a definable critical impact force being transmitted through the coupling shaft (1) to the drawgear (2), the connection between the drawgear (2) and the coupling shaft (1) is disengaged and the coupling shaft (1) is at least partially removed from the power flow transmitted to the drawgear (2).

23 Claims, 5 Drawing Sheets

CENTRAL BUFFER COUPLING FOR RAIL-MOUNTED VEHICLES

The present invention relates to a central buffer coupling for rail-mounted vehicles having a coupling shaft and a drawgear comprising a bearing bracket, whereby the rear end of the coupling shaft is connected to the drawgear and coupled to the car body of the rail vehicle via the bearing bracket of the drawgear so as to be horizontally pivotable.

BACKGROUND OF THE INVENTION

1. Field of the Invention

This type of coupling arrangement is generally known in the field of railway technology and is used in order produce a force-fit mechanical connection between two adjacent car bodies of a multi-member trainset. So that the coupling shaft can also pivot, for example when the trainset travels through curves, the drawgear is configured such that the coupling drawbar can realize horizontal and vertical swing as well as axial rotation. It is known that, given a rigidly supported coupling device, the impacts and vibrations which occur for example during the coupling procedure or when braking can lead to damaging of the vehicle and/or the coupling arrangement itself. To avoid these types of damages, it is necessary to limit the transmission of such impacts and vibrations and the like to the greatest extent possible. This is preferably achieved by providing the coupling arrangement with elastic cushioning means such as, for example, a tension/shock device to absorb such impacts. As an example, the drawgear can comprise a bearing bracket with a tension/shock device, whereby the tension/shock device elastically routes tractive and compressive forces up to a defined magnitude through the bearing bracket to the vehicle underframe. The objective is the absorption of energy by means of elastic deformation and thus avoiding overstressing of the underframe.

Further known in the field of rail vehicle technology is the use of multi-stage energy absorption devices. Same usually comprise a reversible energy absorption device as the primary stage, integrated for example as a tension/shock device in the drawgear or as a coupler spring in the coupling shaft of the central buffer coupling and which is designed to absorb impacts occurring during travelling, shunting and coupling. A second, secondary energy absorption device to absorb impact energy from excessive overrun impacts is moreover frequently provided in the form of two side buffers disposed at the outer edge of the respective car body's face side. The energy absorption devices are thereby configured such that the conversion of impact energy resulting from shunting accidents is effected as two transitioning processing operations, whereby the first stage is integrated in the central buffer coupling and the second stage is upstream the load-bearing car body structure.

Another approach provides for diverting the residual energy to energy absorption elements on the car body itself, for example friction elements, by means of a pre-set breaking point in the coupling arrangement after the energy absorption device provided for the coupling has been exhausted. However, this presupposes that the coupling shaft with the coupler head can be taken out of the power flow transmitted by the coupling arrangement upon a defined level of force being exceeded and thus allows an impact of the car bodies and the employing of energy absorption elements on the car body. The coupling shaft with the coupler head is usually removed from the power flow by having the coupling shear off at a pre-set breaking point such that most of the coupling arrangement is pushed backward into an area provided for the purpose in the underframe of the vehicle. A coupling's shearing function is usually attained by having the coupling shaft itself be attached to the drawgear or an articulation via the bearing bracket and via an external shearing element on the car body underframe which allows the shearing function. This design in which the bearing bracket is affixed to the underframe of the car body with external shearing elements does, however, presuppose that a corresponding opening be provided for the bearing bracket contact surface on the back side relative the car body's fixing plate in order to affix the external shearing elements from the back side to the underframe of the car body in mounting the drawgear and the bearing bracket associated with the drawgear on the respective face side of the car body. This has the consequence of making the fitting of external shearing elements a very complex and cost-intensive procedure. Moreover, a relatively large opening must in essence be provided in the fixing plate of the car body. The same difficulties also arise when the drawgear and the drawgear's associated bearing bracket are not mounted directly to the fixing plate of the car body but rather make use of an adapter plate.

2. The Prior Art

A perspective view of a drawgear 102 for a central buffer coupling for rail-mounted vehicles as known from the prior art is shown in FIG. 1. FIG. 2 shows the drawgear 102 of FIG. 1 in a sectional side view. This drawgear 102 is part of a central buffer coupling in which a tension/shock absorber 110 comprising an elastomeric spring element is integrated into the drawgear 102. It is hereby provided for the elastomeric spring element 110 to absorb the tractive/compressive forces up to a defined magnitude. Thus, the tractive/compressive forces occurring between the individual car bodies during normal travel are absorbed. When, however, the working load is exceeded, for instance when the vehicle collides with an obstacle, it can be that the energy absorption of the tension/shock absorber 110 provided in the drawgear 102 will not be sufficient. So that this excess impact-energy will not be transmitted directly to the vehicle underframe, subjecting same to extreme loads, the bearing bracket 104 of drawgear 102 is affixed to the car body, or the underframe of the car body respectively, by means of external shearing elements 108. This can especially be seen in FIG. 3 which shows a top plan view of the drawgear 102 of FIG. 1 in a mounted state on the underframe of the car body. The external shearing elements 108 respond upon the critical impact forces rated for the tension/shock absorber 110 being exceeded, whereupon they lose their function as fixing elements and the entire coupling assembly is taken out of the transmitted power flow.

Apart from the disadvantage that a relatively large opening 107 must be provided in the fixing plate 117 of the car body in order to mount the bearing bracket 104 of drawgear 102 to the vehicle underframe, the solution shown in FIG. 3 has the further disadvantage that the bearing bracket 104 can only be affixed to the car body with the external shearing elements 108 from the rear side of the fixing plate 117. Coupling assemblies in which bolting the drawgear from the rear side is not possible, for example because of a direct proximity to a bogie, cannot make use of such a shear-off solution for the coupling.

SUMMARY OF THE INVENTION

The present invention is thus based on the task of further developing a central buffer coupling of the type indicated at the outset such that in the event of a crash; i.e., upon an occurrence of extreme impact energy, the connected coupling is truncated such that the energy absorption elements on the respective car bodies absorb the impact energy being transmitted between adjacent car bodies upon impact without the need for external shearing elements to be provided in the area behind the coupling in order to take the coupling out of the power flow.

This task is solved by a central buffer coupling for rail-mounted vehicles of the type indicated at the outset in that the drawgear itself comprises a shock absorber, whereby the shock absorber is configured such that upon the exceeding of a definable critical impact force being transmitted through the coupling shaft to the drawgear, the connection between drawgear and coupling shaft disengages and the coupling shaft is at least partially removed from the power flow transmitted to the drawgear.

The solution according to the invention has an entire array of substantial advantages over the central buffer couplings known in the field of rail vehicle technology and as described above. By providing for a shock absorber in the drawgear itself, which responds upon a specific force transmitted from the coupling shaft to the drawgear being exceeded, the connection between the drawgear and the coupling shaft disengages which allows for the coupling shaft to be removed from the power flow transmitted to the drawgear, whereby the energy absorbing elements provided on the respective car bodies are then employed to reliably dissipate the transmitted impact energy. This thus achieves the maximally attainable and in particular calculable energy absorption for a foreseeable sequence of events. Having the shock absorber be integrated into the drawgear itself according to the invention does away with the need to use external shearing elements to affix the bearing bracket to the car body drawgear and provide the shock absorbing function. With the inventive coupling arrangement, it is accordingly no longer necessary to provide an opening in the fixing plate of the car body through which the bearing bracket passes in order to be mounted from the rear side of the fixing plate to the car body with external shearing elements. It is instead now possible for the drawgear bearing bracket to be fixed directly to the car body from the front side of the fixing plate, for example with screws.

Preferred embodiments of the invention are indicated in the dependent claims.

Cited as an example is providing for the shock absorber to have an opening configured to the bearing bracket of the car body for the central buffer coupling through which at least part of the coupling shaft is pushed upon the critical impact force being exceeded and thus removed from the power flow. The opening configured in the bearing bracket allows for the coupling shaft disengaged from the drawgear following response of the shock absorber to move backward into an area provided external the coupling plane and thus taken out of the power flow. This solution is of particular advantage due to the fact that the drawgear providing the shock absorbing or shearing function can thus be mounted from the front side of the fixing plate without needing to have an opening provided in the fixing plate of the car body. It is also conceivable to provide an opening in the fixing plate itself corresponding to the opening in the bearing bracket through which the coupling shaft is at least partially pushed upon the critical impact force being exceeded and thus taken out of the power flow after the coupling shaft passing through the opening provided in the bearing bracket. In place of an opening provided right on the fixing plate of the car body, the material of the fixing plate or the fixing plate itself can also be accordingly designed (for example as a perforation corresponding to the opening) such that the coupling shaft only penetrates to the slightest degree possible upon the critical impact force being exceeded and upon response of the shock absorber provided in the drawgear; i.e., it only requires a minimum resistance to pierce the material of the fixing plate and thus be pushed through the opening thus realized in the fixing plate.

An advantageous further development of the latter embodiment provides for the bearing bracket of the drawgear not being mounted directly to the fixing plate of the car body but rather by means of an additional support plate, adapter plate respectively, whereby the support plate can further comprise an opening corresponding to the opening provided in the bearing bracket. The embodiment has the advantage that the central buffer coupling with the shock absorber according to the invention can be of modular configuration and can thus be mounted to differently-configured fixing plates without laborious retrofitting measures. As indicated in the previous embodiment, it is also conceivable here to not initially provide any opening in the support plate itself but rather have the corresponding opening become configured once the coupling shaft has passed through the opening provided in the bearing bracket.

A particularly advantageous realization of the central buffer coupling according to the invention further provides for the drawgear to comprise a guide in order to at least partially guide the movement of the coupling shaft out of the power flow transmitted to the drawgear upon the exceeding of the critical impact force. This guide enables a very precise foreseeable sequence of events since the coupling shaft can be removed from the power flow in a controlled manner upon the exceeding of a defined level of force and thus allow the car bodies to collide and the energy absorption elements on the car body to be employed.

A particularly advantageous realization of the latter embodiment provides for the guide to have an oblique contact surface directed toward the opening disposed in the bearing bracket, whereby the guide is configured such that the coupling shaft is pushed through the opening in the bearing bracket upon the critical impact force being exceeded. This guide design is particularly simple to realize, maintenance-free and of reliable functioning. Of course, other embodiments of the guide are also conceivable.

It is particularly preferred for the shock absorber to comprise at least one shearing element by means of which the coupling shaft is connected to the drawgear, whereby the shearing element is configured such that it shears off upon a critical impact force being transmitted from the coupling shaft to the drawgear and the connection between the coupling shaft and the drawgear thus being disengaged. To be understood by the term "shearing element" is a connecting member which breaks or shears off upon a specific force in the longitudinal and/or transverse direction of the coupling shaft being exceeded and thereby loses its function as a connecting member. It is thereby conceivable for the shearing element to be configured such that only moments of force about a specific axis, for example the longitudinal axis of the coupling shaft, will effect a response from the shock absorber. Of course, other embodiments of the shearing element are also conceivable. For example, the shearing element can also be configured such that it responds to a specific force being exceeded both in the longitudinal as well as the transverse direction of the coupling shaft, thereby losing its function as a connecting member. It is also conceivable to configure the shearing element such that it only responds upon impact forces and not tractive forces.

In a special embodiment, the shock absorber comprises a shearing element having at least one pre-set breaking point which breaks upon a definable critical impact force so that the shearing element loses its function as a connecting member and the connection between the coupling shaft and the drawgear is thus disengaged. The advantage of a pre-set breaking point can be seen in that such a shearing element is particularly simple to realize, whereby the shearing element response can still be set to be extremely reliable. In other words, this means that the critical impact force upon which the shearing element of the shock absorber is activated and loses its function as a connecting member can be exactingly predefined.

It is particularly preferred for the central buffer coupling according to the invention to be used in a coupling mechanism in which the drawgear is an eyebolt drawgear, whereby the shearing element is then the pin of the eyebolt drawgear and whereby the coupling shaft with the eye of the eyebolt drawgear is taken out of the power flow transmitted to the drawgear upon a defined critical impact force being exceeded. Conceivable here would be for the pin serving as the shearing element to break and thus lose its function as a connecting member upon the defined critical impact force being exceeded, in consequence of which the coupling shaft with the eye provided at its rear end is taken out of the power flow by, for example, being pushed through the opening configured in the bearing bracket of the car body.

Another solution, even as known to some degree in the field of rail vehicle technology, provides for the central buffer coupling to further comprise an elastomeric spring mechanism to cushion tractive and impact forces transmitted from the coupling shaft to the drawgear. It is hereby provided for the elastomeric spring mechanism to comprise a housing open to the coupler head in which the rear end of the coupling shaft projects coaxially at a radial spacing from the inner circumferential surface of the housing, wherein the rear end of the coupling shaft is thus connected to the drawgear via the housing. In the case of an elastomeric spring mechanism comprising integrated elasto-meric springs, it is advantageous to provide pretensioned spring washers made from an elastic material between the inner circumferential surface of the housing, their central planes being aligned vertically and arranged behind one another at a reciprocal spacing in the longitudinal direction of the coupling shaft. Instead of a plurality of individual washers arranged behind one another, however, it is also possible here to use a single cylindrical elastomeric element (elastomeric cylinder), its outer peripheral surface provided with annular circumferential elastomeric beads. In one possible realization of the elastomeric spring mechanism, both the rear end of the coupling shaft as well as also the interior of the housing are provided with circumferential annular beads in alignment with one another, whereby each of the spring washers made from an elastic material, the cited elastomeric cylinder with the annular beads respectively, is held in a gap between two adjacent annular beads opposite the rear end of the coupling shaft and the housing, whereby each spring washer directly abuts both the circumferential surface of the coupling shaft as well as the inner circumferential surface of the housing, and whereby the annular beads of the coupling shaft are aligned flush with the associated annular beads of the housing in the unloaded state of the elastomeric spring device with respect to the tractive and impact forces. The invention now provides for using the at least one shearing element to connect the housing of the elastomeric spring mechanism with the drawgear such that upon the predefined critical impact force being exceeded, the coupling shaft with the housing comprising the elastomeric spring mechanism disposed therein is taken out of the power flow transmitted to the drawgear. What this inventive solution allows is that the shock absorber disposed in the drawgear can also be used in drawgears which make use of an elastomeric cushioning coupling (ECC). It is pointed out in this respect that this embodiment is, of course, not limited only to elastomeric spring mechanisms, but can also be used in other drawgears comprising integrated tension/shock devices. For example, such a tension/shock device can also be configured with hollow rubber springs, friction springs, hydraulic mechanisms or combinations thereof. It is also conceivable to further use destructive impact elements in addition to regenerative impact elements. A further advantage of this embodiment lies in that after exceeding the critical impact force, not only the coupling shaft but also the housing of the bearing bracket is taken out of the power flow by the connection between drawgear and coupling shaft being separated so that the housing remains in its original position on the car body. Specifically, the housing of the bearing bracket together with the drawgear is thereby no longer urged into the area provided for the purpose in the underframe of the car body, as is the case in conventional central buffer couplings. Instead, the housing remains on the car body and assumes the function of a "guiding profile" or a "pick-up member" relative the coupling shaft disengaged from the drawgear, since the coupling shaft in or on the housing can be supported and thus prevents the separated coupling shaft from falling onto the track.

It is in particular preferred to configure the inventive central buffer coupling according to the latter embodiment; i.e., the central buffer coupling with the elastomeric cushioning coupling, so that the tractive and impact forces transmitted through the coupling shaft to the drawgear be cushioned to a predefined magnitude by regenerative deformation of the washers, the tension/shock device provided in the drawgear respectively, whereby the predefined magnitude is set at a value lower than the release force of the at least one shearing element. This thereby has the result of the tension/shock device accommodating tension and compression up to a predefined magnitude and absorbing and thus eliminating lesser impacts such as the impacts and vibrations which occur during travel and when braking, for example. The forces in excess thereof, for instance when the vehicle collides with an obstacle, cause the shock absorber integrated into the drawgear and in particular the shearing element to respond, whereby the connection between the drawgear and the coupling shaft is disengaged and at least part of the coupling shaft is removed from the power flow transmitted to the drawgear, whereupon after the energy absorption device provided in the drawgear being exhausted, the residual energy is transmitted to energy absorption elements disposed on the car body, for example friction elements. The advantage in this is being able to achieve the greatest calculable energy absorption possible in a foreseeable sequence of events in the event of an accident since the central buffer coupling is taken out of the power flow upon a defined level of force being exceeded and thus allows the car bodies to collide and the energy absorption elements on the car body to be employed.

The central buffer coupling according to the invention with the elastomeric spring mechanism advantageously provides for the drawgear to comprise at least one vertically extending pivot pin which connects the housing by means of the at least one shearing element and which is arranged to be horizontally pivotable on the bearing bracket of the car body. It is hereby preferred for the shearing element to be disposed between the at least one pivot pin and the housing. It would also be conceivable here to connect the pivot pin directly to the housing, whereby this connection should then have a pre-set breaking point. In order to ensure the most stable horizontally pivoting drawgear to the housing on the bearing bracket as possible, it is preferred to provide a plurality of vertically extending pivot pins, whereby a shearing element can be provided for each individual pivot pin.

In order to achieve an elastomeric spring mechanism which is as simple as possible to realize and in particular as simple as possible to mount, it is preferable to provide for the housing of the elastomeric spring mechanism which is joined to the bearing bracket of the car body with the at least one shearing element so as to be horizontally pivotable, to be comprised of two half shells detachably connected to one another. Conceivable as such a connection would be, for example, threaded bolts. Using not two but a plurality of housing members would of course also be conceivable. This would facilitate the mounting of the washers. Furthermore, washers of a certain oversize can be mounted with the threaded bolts or screws at perpendicular pretensioning to the longitudinal direction of the coupling shaft, which produces a firm seating for the washers between the coupling shaft and the housing.

A further development of the central buffer coupling comprising the elastomeric spring mechanism provides for the coupling shaft to exhibit a flange on its section facing the housing opening, the rear end of which on the one hand abuts a pretensioned washer and, on the other hand, its face side abuts the washer closest to the housing opening, whereby the pretensioning preloads the washers in the longitudinal direction of the coupling shaft in the unloaded state of the elastomeric spring mechanism. This thereby achieves the elastomeric spring mechanism being subjectable to a selective, reproducible pretensioning based on magnitude and direction. The generation as well as the adjusting of the spring mechanism pretensioning is moreover simplified.

A more exacting and finer setting of the pretensioning of the elastomeric spring mechanism is preferably achieved by a construction in which the generating as well as the adjusting of the pretensioning force in the longitudinal direction of the coupling shaft ensues by means of a pressure member which is affixed to and supported on the housing with screws.

DETAILED DESCRIPTION OF AN ILLUSTRATIVE EMBODIMENT

Figure 1:
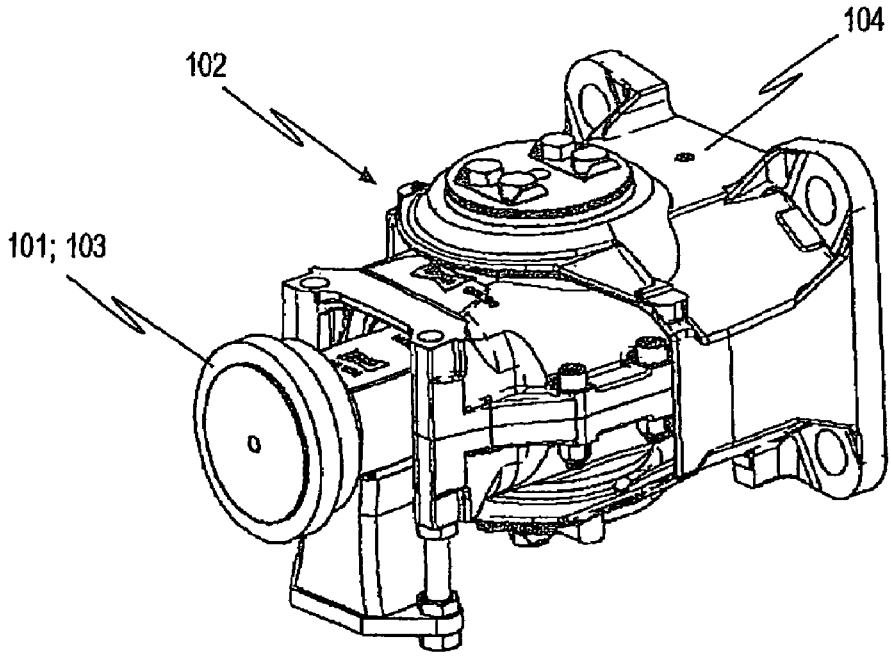
Fig. 1 (Prior Art)
FIG. 1 is a perspective view of a known prior art drawgear for a central buffer coupling.
Figure 2:
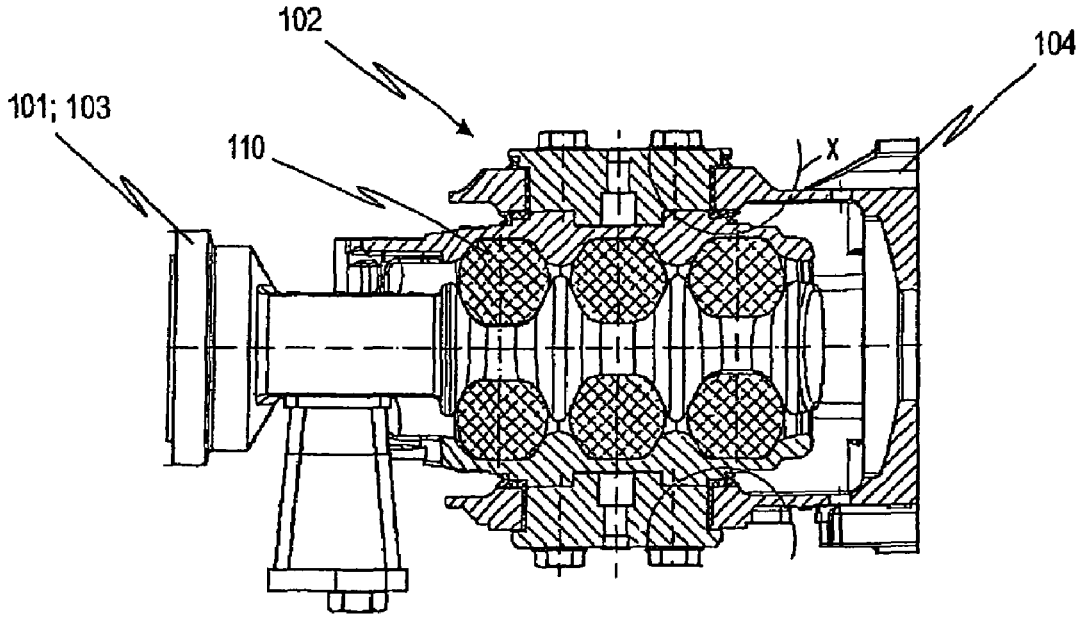
Fig. 2 (Prior Art)
FIG. 2 is a sectional side view of the drawgear according to FIG. 1.

FIG. 1 shows a drawgear 102 used in a central buffer coupling known from the prior art in a perspective view. FIG. 2 shows a sectional side view of the drawgear 102 of FIG. 1. As depicted, an elastomeric spring element 110 is integrated into drawgear 102 as a tension/shock device. This spring element 110 is configured such that tension and compression is absorbed up to a fixed predefined magnitude and forces which exceed same are relayed through bearing bracket 104 to the vehicle underframe. The drawgear 102 shown in FIGS. 1 and 2 encompasses the rear part of the coupling arrangement and serves to couple the coupling shaft 101 with a rear end 103 via the bearing bracket 104 to the (not explicitly shown) fixing plate of the car body in horizontally pivotable fashion.

Figure 3:
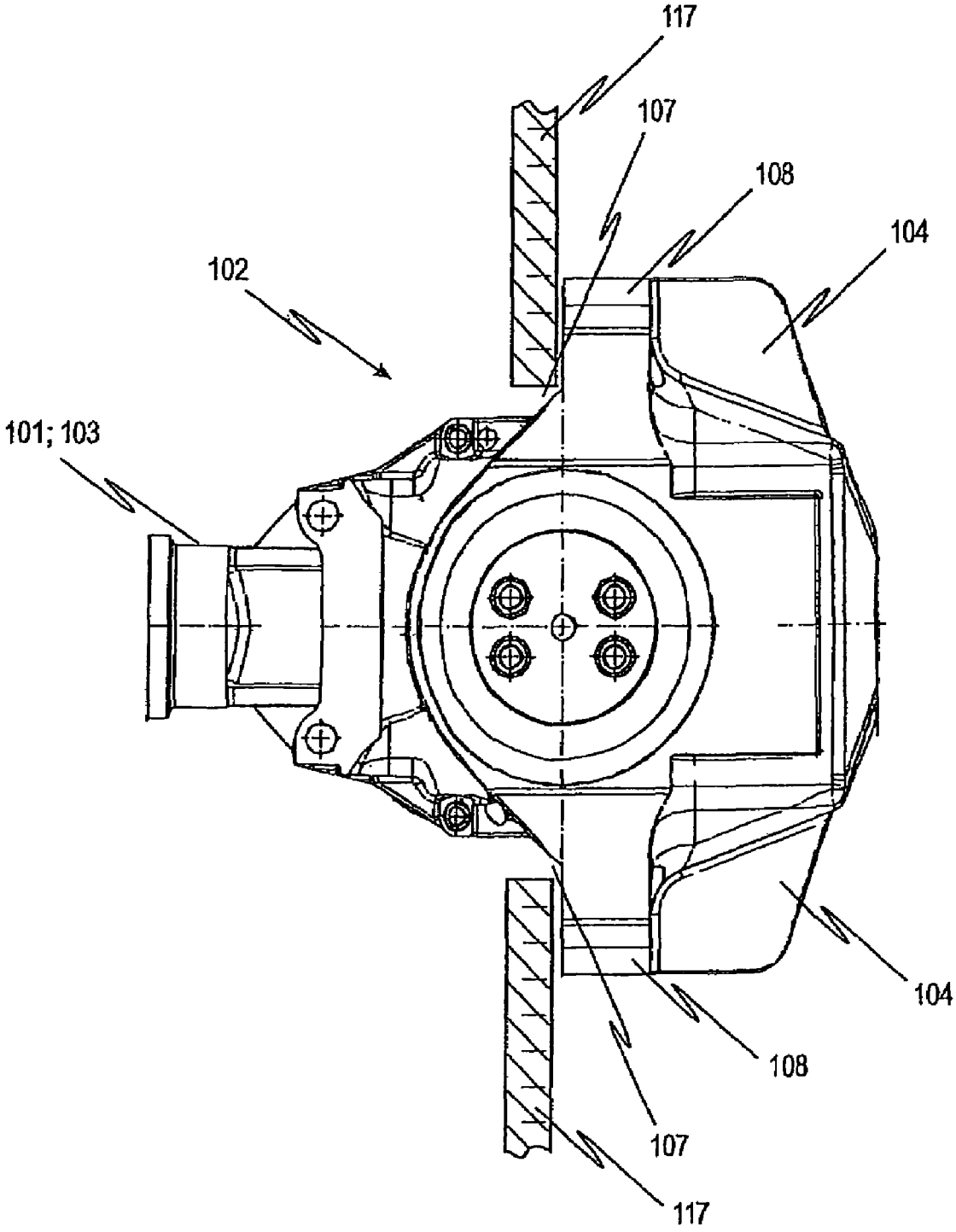
Fig. 3 (Prior Art)
FIG. 3 is a top plan view of the drawgear according to FIG. 1.

FIG. 3 shows a top plan view of the drawgear 102 known from the prior art and shown in FIGS. 1 and 2. In the selected representation of FIG. 3, the bearing bracket 104 of the drawgear 102 is affixed to the fixing plate 117 of the car body. A corresponding opening 107 is provided in the fixing plate 117 through which part of the bearing bracket 104 protrudes. The bearing bracket 104 itself is affixed to the underframe of the car body by external shearing elements 108. It can be seen from FIG. 3 that the fixing of bearing bracket 104 via the external shearing elements 108 can only ensue from the rear side of fixing plate 117. The external shearing elements 108 are configured such that they respond in the event of a crash; i.e. upon extreme impact energy, and thereby lose their function as fixing elements for the bearing bracket 104. In such a case, the bearing bracket 104 together with the drawgear 102 and the coupling shaft 101 coupled thereto can be pushed into an area (not explicitly shown) provided for the purpose in the car body underframe and thus at least partially removed from the power flow transmitted by the coupling arrangement.

As stated above, the known prior art solution in which external shearing elements 108 are provided has various different disadvantages in, on the one hand, the fixing of the bearing bracket 104 of the drawgear 102 to the car body and, on the other hand, in the assuming of the shock absorbing function, which will only be addressed briefly in the following so as to avoid repetition. Proven on the one hand to be of disadvantage is that a relatively large opening 107 needs to be provided in the fixing plate 117 of the car body in order to affix the bearing bracket 104 of drawgear 102 to the vehicle underframe with external shearing elements 108. Moreover, the bearing bracket 104 (the external shearing elements 108 respectively) can only be affixed to the car body from the rear side of fixing plate 117. This disadvantage is of particularly marked significance with respect to an economical solution for a drawgear comprising a shock absorbing function since it makes mounting the drawgear 102 to the car body extremely time-intensive and complex.

Figure 4:
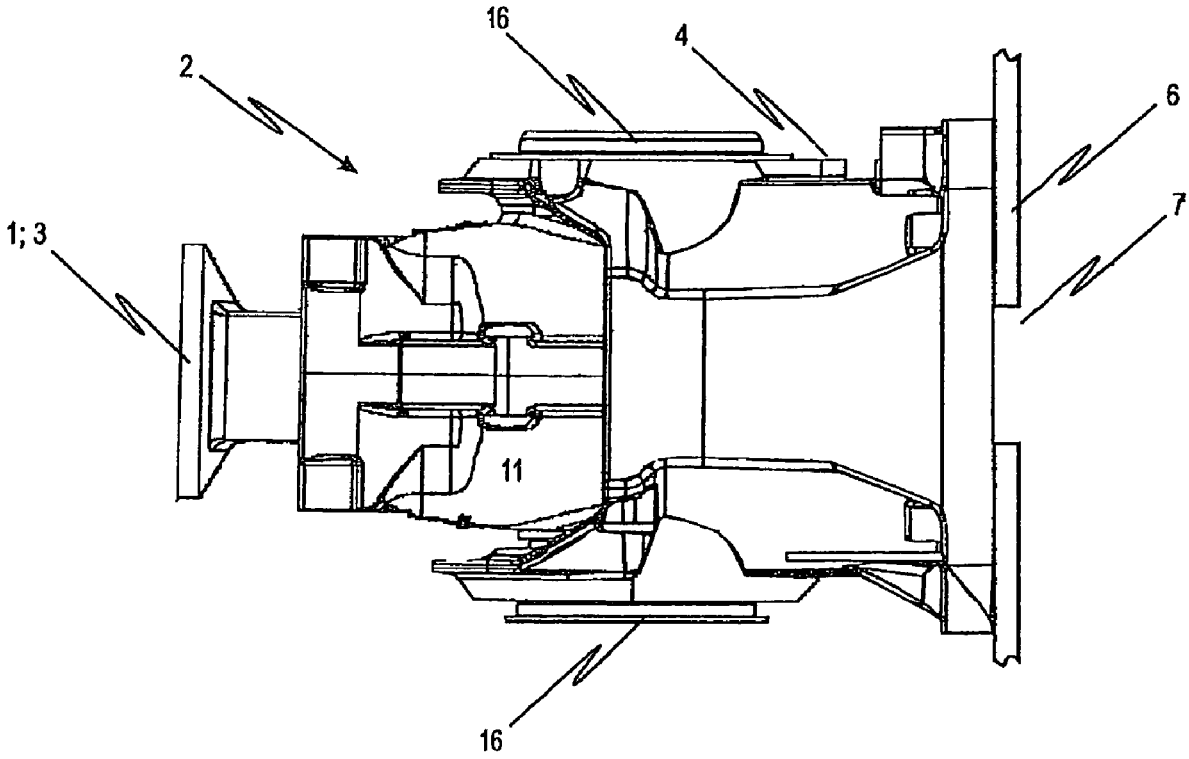
FIG. 4 is a side view of a drawgear in a preferred embodiment of the central buffer coupling according to the invention.
Figure 5:
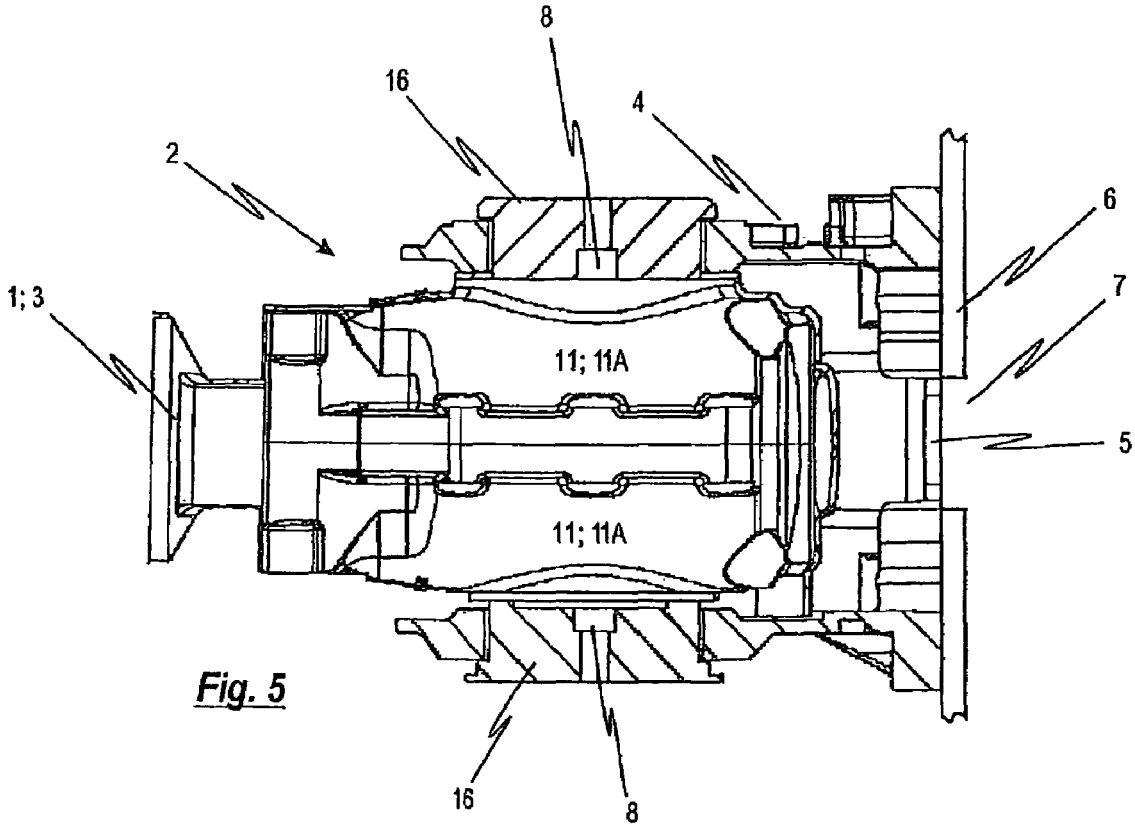
FIG. 5 is a partial sectional view of the drawgear according to FIG. 4.
Figure 6:
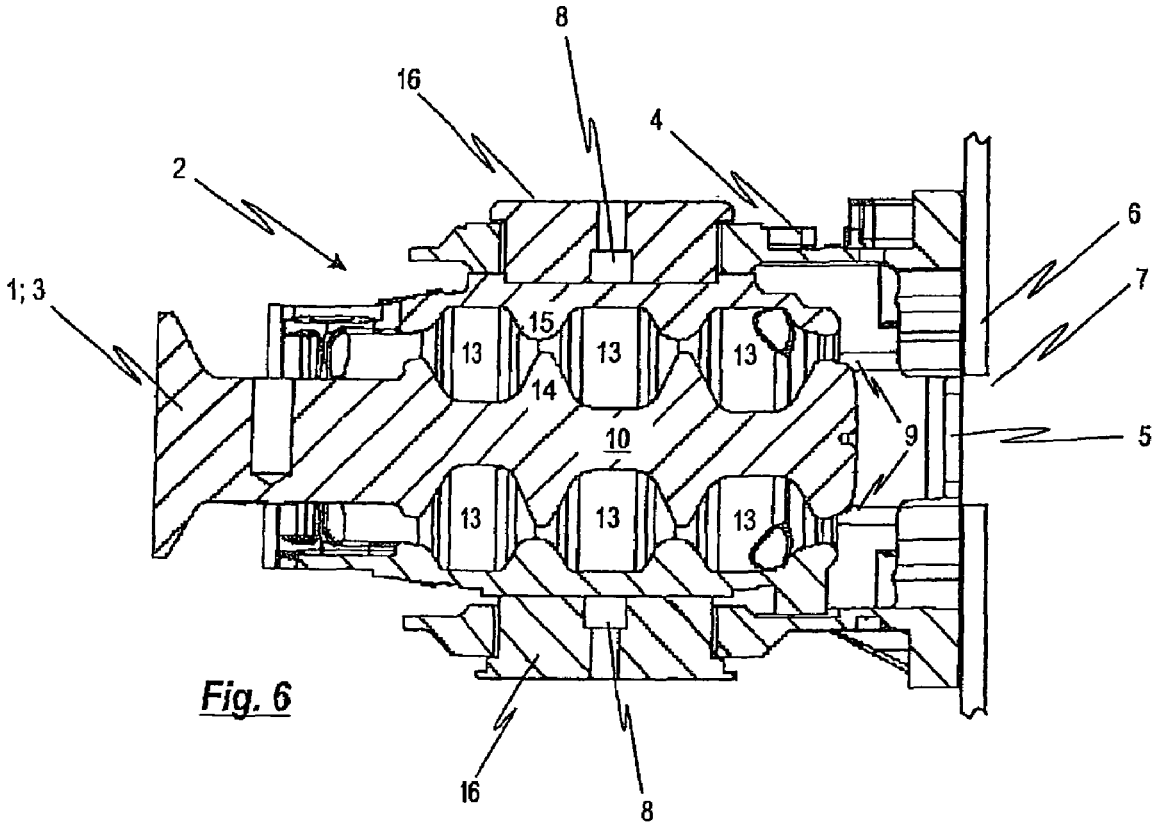
FIG. 6 is a full sectional view of the drawgear according to FIG. 4.

FIG. 4 is the side view of a drawgear 2 of a preferred embodiment of the central buffer coupling according to the invention. FIG. 5 shows a partial sectional view of the drawgear 2 according to FIG. 4, while FIG. 6 shows it in a full sectional view.

The drawgear 2 of the preferred embodiment according to the present invention comprises an elastomeric spring mechanism 10 to absorb tractive and impact forces transmitted through coupling shaft 1 to drawgear 2. It is thereby provided for the elastomeric spring mechanism 10 to have a (not explicitly shown) housing 11 composed of half shells 11A and open to the coupler head in which the rear end 3 of coupling shaft 1 coaxially protrudes at a radial spacing of the inner circumferential surface of housing 11. The rear end 3 of coupling shaft 1 is connected to the drawgear 2 through housing 11. In the embodiment shown in FIGS. 4 to 6, this connection ensues by means of vertically extending pivot pins 16, with which the housing 11 is connected via shearing elements 8 and coupled with bearing bracket 4 of the car body so as to be horizontally pivotable.

Pretensioned spring washers 13 made of an elastic material are provided between the inner circumferential surface of housing 11, the central planes of which are aligned vertically and arranged behind one another at a reciprocal spacing in the longitudinal direction of coupling shaft 1, whereby both the rear end 3 of coupling shaft 1 as well as the interior of the housing 11 exhibit peripheral annular beads 14, 15 in alignment with one another. Said annular beads 14, 15 are configured such that each spring washer 13 is held in the gap between two neighboring annular beads 14, 15 opposite the read end 3 of coupling shaft 1 and housing 11. Since each spring washer 13 is disposed directly both on the peripheral surface of coupling shaft 1 as well as on the inner circumferential surface 12 of housing 11, whereby in the unloaded state of the elastomeric spring mechanism 10 with respect to tractive and impact force, the annular beads 14 of coupling shaft 1 align flush with the associated annular beads 15 of housing 11, this enables, on the one hand, a cardanic motion to coupling shaft 1 and, on the other, the accommodating and absorbing of tractive and compressive forces up to a fixed defined magnitude.

As stated above, the housing 11 for the elastomeric spring mechanism 10 is connected to drawgear 2 by means of at least one shearing element 8. In the preferred embodiment according to FIGS. 4 to 6, drawgear 2 exhibits a vertically-extending upper and lower pivot pin 16, at which the housing 11 is in each case connected by means of a shearing element 8 and coupled to bearing bracket 4 of the car body so as to be horizontally pivotable. It is preferably provided for the release load of shearing element 8 to be greater than the magnitude of force which the elastomeric spring mechanism 10 can transmit by the regenerative deformation of spring washer 13.

The housing 11 for the elastomeric spring mechanism 10 is preferably of apportioned configuration in order to ensure a particularly simple fitting of spring mechanism 10. Furthermore, the pretensioning of the elastomeric spring mechanism 10 in the longitudinal direction of coupling shaft 1 can hereby be produced particularly readily. It would also be hereby conceivable for the rear end 3 of coupling shaft 1 to exhibit a (not explicitly shown) flange, abutted on the one hand at the rear end by a (not explicitly shown) pretensioned washer and, on the other hand, its face side abutting the spring washer 13 closest to the opening of housing 11, whereby the pretensioning of spring washer 13 is stressed in the longitudinal direction of coupling shaft 1 in the unloaded state of elastomeric spring mechanism 10.

The shock absorber 5, 8 of drawgear 2 as depicted in FIGS. 4 to 6 consists of an opening 5 provided in bearing bracket 4 and the previously-cited shearing elements 8 and is configured such that upon the exceeding of a definable critical impact force being transmitted through coupling shaft 1 to drawgear 2, the connection between drawgear 2 and coupling shaft 1 is disengaged and the coupling shaft 1 is at least in part taken out of the power flow transmitted to drawgear 2. This ensues due to, on the one hand, the housing 11 being connected to drawgear 2 by means of the at least one shearing element 8 and, on the other, by the opening 5 to the central buffer coupling configured in bearing bracket 4, through which the coupling shaft 1 is at least partially pushed and thus taken out of the power flow upon the critical impact force being exceeded and following response of the shearing elements 8.

The solution according to the invention in which the shock absorber 5, 8 is contained in the drawgear 2 enables drawgear 2 with bearing bracket 4 to be mounted directly to fixing plate 6 of the car body without the need for providing a corresponding mounting opening for same, and without needing to affix bearing bracket 4 from the rear side of fixing plate 6 of the car body via external shearing elements. Although, as FIGS. 4 to 6 depict, additionally to the opening 5 provided in bearing bracket 4, there can also be an opening 7 provided in fixing plate 6, whereby both openings 5, 7 advantageously correspond to one another. In the event of a crash, after shearing elements 8 have responded and have lost their connective function, such a configuration first has the effect of pushing the coupling shaft 1 through the opening 5 provided in bearing bracket 4 and then through the opening 7 provided in fixing plate 6 and it thus being taken out of the power flow. Instead of an additional opening 7 in fixing plate 6, it is also conceivable for the material of fixing plate 6 to be correspondingly designed such that after the response of the shearing elements 8, the coupling shaft 1 can be pushed into an area provided behind the fixing plate 6 without too much resistance. But it is of course also conceivable for the bearing bracket 4 to be initially configured without opening 5 and that in the position provided for opening 5, the material of bearing bracket 4 be accordingly configured or designed so as to enable an easy penetration for the drawbar upon the critical impact force being exceeded.

Unlike the drawgears known in the prior art in which shock absorption is provided by means of external shearing elements and in which the entire drawgear with the associated bearing bracket is sheared off and taken out of the power flow upon the critical impact force being exceeded, the solution according to the invention results in only the coupling shaft 1 breaking away and being taken out of the power flow in the event of a crash, without drawgear 2 and without bearing bracket 4.

In the preferred embodiment depicted in FIGS. 4 to 6, a guide 9 is further provided to guide the movement of coupling shaft 1 with the housing 11 and the elastomeric spring elements 10 provided therein through the opening 5 of bearing bracket 4 and ultimately through the opening 7 of support plate 6 upon the exceeding of the critical impact force and upon response of the shearing elements 8. Said guide 9 thus enables a very precise foreseeable sequence of events.

Figure 7A:
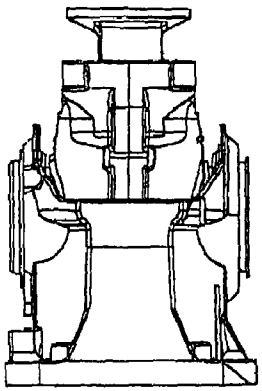
FIGS. 7A-F are depictions of the drawgear of the central buffer coupling according to FIG. 4 in various different states.
Figure 7B:
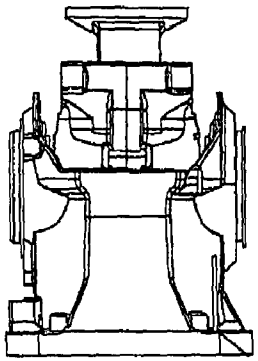
Figure 7C:
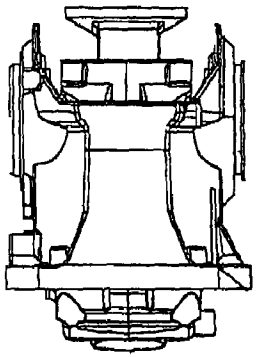
Figure 7D:
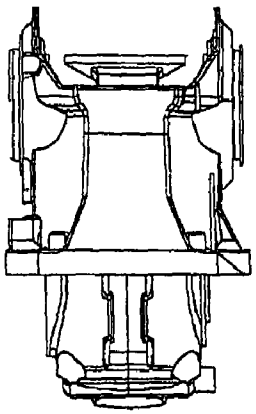
Figure 7E:
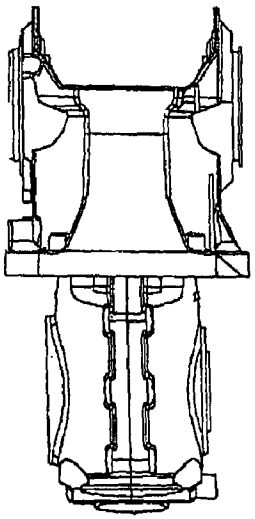
Figure 7F:
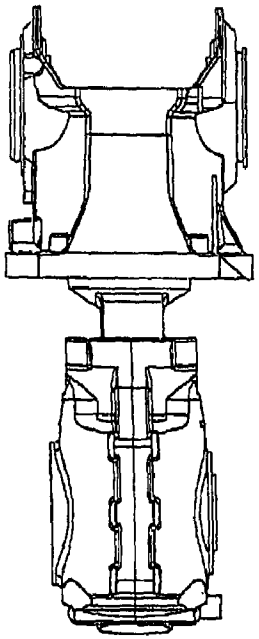

FIGS. 7A through FIG. 7F show the drawgear according to FIGS. 4 to 6 in various different states. FIG. 7A shows the drawgear in an unloaded state. In this state, the annular beads of the coupling shaft are flush with the associated annular beads of the housing. FIG. 7B shows the elastomeric spring mechanism in a loaded state with respect to tractive and impact forces. As depicted, the coupling shaft with the elastomeric spring mechanism provided at its end is displaced somewhat toward the car body in comparison to the state in FIG. 7A. However, the impact force which acts on the coupling shaft in the state depicted in FIG. 7B is still below the critical impact force at which the shearing elements respond. FIG. 7C shows a loaded state of the drawgear following response of the shock absorber in which the shearing elements have already been activated and have lost their function as fixing means such that the coupling shaft (only the rear part is depicted in the figures) together with the housing which contains the elastomeric spring mechanism is pushed out of the power flow. FIGS. 7D to 7F show the further movement of the rear end of the coupling shaft after the shock absorber has responded, whereby the coupling shaft is sequentially pushed completely out of the coupling plane into an area provided behind the fixing plate of the car body (not explicitly shown) and thus removed from the power flow until ultimately reaching the state shown in FIG. 7F.

To be stated at this point is that FIGS. 4 to 7 illustrate the inventive coupling arrangement using a central buffer coupling having an elastomeric spring mechanism. However, the idea behind the invention, namely that of integrating a shock absorber in the drawgear, is also possible with other coupling arrangements, for example an eyebolt drawgear.

The invention claimed is:

1. A central buffer coupling for rail-mounted vehicles having a coupling shaft with a rear end and a drawgear comprising a bearing bracket, the rear end of the coupling shaft being connected by a shearing element connection to the drawgear so as to be horizontally pivotable, said drawgear being coupled directly to the car body of the rail vehicle via the bearing bracket of the drawgear, wherein a shock absorber is provided in the drawgear, and the shock absorber is configured such that the exceeding of a definable critical impact force being transmitted through the coupling shaft to the drawgear disengages the connection between the drawgear and the coupling shaft and the coupling shaft is at least partially removed from the power flow transmitted to the drawgear.

2. The central buffer coupling according to claim 1, wherein the shock absorber comprises an opening in the bearing bracket to the central buffer coupling, through which at least part of the coupling shaft is pushed upon the critical impact force being exceeded and thus removed from the power flow.

3. The central buffer coupling according to claim 2, wherein the drawgear further comprises a guide which at least partially guides the movement of the coupling shaft out of the power flow transmitted to the drawgear upon the exceeding of the critical impact force.

4. The central buffer coupling according to claim 2, wherein the guide has an oblique contact surface directed toward the opening disposed in the bearing bracket which is configured such that the coupling shaft is pushed through the opening in the bearing bracket upon the critical impact force being exceeded.

5. The central buffer coupling according to claim 2, wherein the shock absorber comprises at least one shearing element by means of which the coupling shaft is connected to the drawgear, and the shearing element is configured such that it shears off upon a critical impact force being transmitted from the coupling shaft to the drawgear whereby the connection between the coupling shaft and the drawgear is thus disengaged.

6. The central buffer coupling according to claim 5, wherein the at least one shearing element has at least one pre-set breaking point which breaks upon a definable critical impact force so that the connection between the coupling shaft and the drawgear is disengaged.

7. The central buffer coupling according to claim 5, wherein the drawgear is an eyebolt drawgear, the shearing element is a pin of the eyebolt drawgear, and the coupling shaft with an eye of the eyebolt drawgear is taken out of the power flow transmitted to the drawgear upon a defined critical impact force being exceeded.

8. The central buffer coupling according to claim 2, wherein wherein the drawgear is mounted through the bearing bracket to a fixing plate of the car body, and the fixing plate exhibits an opening corresponding to the opening provided in the bearing bracket.

9. The central buffer coupling according to claim 8, wherein the drawgear further comprises a guide which at least partially guides the movement of the coupling shaft out of the power flow transmitted to the drawgear upon the exceeding of the critical impact force.

10. The central buffer coupling according to claim 8, wherein the guide has an oblique contact surface directed toward the opening disposed in the bearing bracket which is configured such that the coupling shaft is pushed through the opening in the bearing bracket upon the critical impact force being exceeded.

11. The central buffer coupling according to claim 8, wherein the shock absorber comprises at least one shearing element by means of which the coupling shaft is connected to the drawgear, and the shearing element is configured such that it shears off upon a critical impact force being transmitted from the coupling shaft to the drawgear whereby the connection between the coupling shaft and the drawgear is thus disengaged.

12. The central buffer coupling according to claim 11, wherein the at least one shearing element has at least one pre-set breaking point which breaks upon a definable critical impact force so that the connection between the coupling shaft and the drawgear is disengaged.

13. The central buffer coupling according to claim 11, wherein the drawgear is an eyebolt drawgear, the shearing element is a pin of the eyebolt drawgear, and the coupling shaft with an eye of the eyebolt drawgear is taken out of the power flow transmitted to the drawgear upon a defined critical impact force being exceeded.

14. The central buffer coupling according to claim 1, wherein the drawgear further comprises a guide which at least partially guides the movement of the coupling shaft out of the power flow transmitted to the drawgear upon the exceeding of the critical impact force.

15. The central buffer coupling according to claim 1, wherein the shock absorber comprises at least one shearing element by means of which the coupling shaft is connected to the drawgear, and the shearing element is configured such that it shears off upon a critical impact force being transmitted from the coupling shaft to the drawgear whereby the connection between the coupling shaft and the drawgear is thus disengaged.

16. The central buffer coupling according to claim 15, wherein the at least one shearing element has at least one pre-set breaking point which breaks upon a definable critical impact force so that the connection between the coupling shaft and the drawgear is disengaged.

17. The central buffer coupling according to claim 15, wherein the drawgear is an eyebolt drawgear, the shearing element is a pin of the eyebolt drawgear, and the coupling shaft with an eye of the eyebolt drawgear is taken out of the power flow transmitted to the drawgear upon a defined critical impact force being exceeded.

18. The central buffer coupling according to claim 15 which further comprises an elastomeric spring mechanism to cushion tractive and impact forces transmitted from the coupling shaft to the drawgear, wherein the elastomeric spring mechanism comprises a housing open to the coupler head in which the rear end of the coupling shaft projects coaxially at a radial spacing from the inner circumferential surface of the housing, wherein the rear end of the coupling shaft is connected to the drawgear through housing, wherein pretensioned spring washers made from an elastic material are provided between the inner circumferential surface of the housing with their central planes aligned vertically and arranged behind one another at a reciprocal spacing in the longitudinal direction of the coupling shaft, wherein both the rear end of the coupling shaft as well as the interior of the housing exhibit annular beads in alignment with one another, wherein each of the spring washers is held in a gap between two adjacent annular beads opposite the rear end of the coupling shaft and the housing, wherein each washer directly abuts both the circumferential surface of the coupling shaft as well as the inner circumferential surface of the housing, wherein the annular beads of the coupling shaft are aligned flush with the associated annular beads of the housing in the unloaded state of the elastomeric spring device with respect to tractive and impact forces, and the housing is connected to the drawgear by the at least one shearing element such that upon the predefinable critical impact force being exceeded, the coupling shaft with the housing and the elastomeric spring mechanism provided therein is taken out of the power flow transmitted to the drawgear.

19. The central buffer coupling according to claim 18, wherein the elastomeric spring mechanism cushions the tractive and impact forces transmitted through the coupling shaft to the drawgear to a predefined magnitude by regenerative deformation of the washers, and the predefined magnitude is set at a value lower than the release force of the at least one shearing element.

20. The central buffer coupling according to claim 18 or 19, wherein the drawgear comprises at least one vertically extending pivot pin which connects the housing by means of the at least one shearing element and at bearing bracket of the car body so as to be horizontally pivotable.

21. The central buffer coupling according to claim 18 or 19, wherein the housing is of apportioned configuration and composed of half shells detachably connected to one another.

22. The central buffer coupling according to claim 18 or 19, wherein the coupling shaft exhibits a flange at its rear end, against which abuts a pretensioned washer on the one hand and, on the other hand, its face side abuts the washer closest to the opening in the housing, and the pretensioning preloads the spring washers in the longitudinal direction of the coupling shaft in the unloaded state of the elastomeric spring mechanism.

23. The central buffer coupling according to claim 22, wherein the housing is of apportioned configuration and composed of half shells detachably connected to one another, and the pretensioning of the elastomeric spring mechanism is in the longitudinal direction of the coupling shaft via the connection of the half shells of the apportioned housing.

* * * * *